US006206734B1

(12) United States Patent
Liu

(10) Patent No.: US 6,206,734 B1
(45) Date of Patent: Mar. 27, 2001

(54) LOW CROSSTALK CONNECTOR

(75) Inventor: Danny Liu, Taipei (TW)

(73) Assignee: Dan-Chief Enterprise Co., Ltd. (TW)

( * ) Notice: Subject to any disclaimer, the term of this patent is extended or adjusted under 35 U.S.C. 154(b) by 0 days.

(21) Appl. No.: 09/481,890

(22) Filed: Jan. 12, 2000

(30) Foreign Application Priority Data

Jun. 9, 1999 (TW) ..... 088209458

(51) Int. Cl.[7] ..... H01R 23/02
(52) U.S. Cl. ..... 439/676; 439/439; 439/941
(58) Field of Search ..... 439/418, 676, 439/941, 346, 942, 877, 83

(56) References Cited

U.S. PATENT DOCUMENTS 3,951,494 * 4/1976 Romine ..... 439/942
5,772,454 * 6/1998 Long, Jr. ..... 439/83
6,042,427 * 3/2000 Adriaenssens ..... 439/676

* cited by examiner

*Primary Examiner*—Brian Sircus
*Assistant Examiner*—Phuong K T Dinh
(74) *Attorney, Agent, or Firm*—Greer, Burns & Crain, Ltd.

(57) ABSTRACT

An electrical connector for the specifications beyond CAT5e includes a plurality of metal contact assemblies, a housing, and a slit base. The slit base has a plurality of slits for inserting therein the plurality of metal contact assemblies, and the housing has a slot for slidably receiving the slit base and has a plurality of openings for exposing a portion of the metal contact assemblies. Each of the metal contact assembly includes a first metal contact and a second metal contact. Each of the first metal contact has a first contact part and each of the second metal contact has a third contact part. Both of the first and third contact parts are used for making an electrical contact external to the housing. Each of the first metal contact has a second contact part and each of the second metal contact has a fourth contact part, and both of the second and fourth contact parts are used for welding on a printed circuit board (PCB), displacing the wire insulation, piercing a cable and electrically connecting with the cable, or fixing a cord by means of squeezing. The first metal contact and the second metal contact are inserted into the slits in turn and in parallel so as to form a desired capacitance for reducing the crosstalk interference.

23 Claims, 7 Drawing Sheets

LOW CROSSTALK CONNECTOR

FIELD OF THE INVENTION

The present invention relates to an electrical connector, and more particularly to an electrical connector structure which can reduce the crosstalk interference generated during the signal transmission.

BACKGROUND OF THE INVENTION

Typically, in a microelectronic circuit, an electrical connector is used to connect the host machine with a plurality of peripheral equipment for transmitting electric signals. Among the miscellaneous electrical connectors, a network connector, however, is particularly applied in the field involved with the network communication. The network connector can be divided into two categories: a network socket and a network cable plug, wherein the latter is directly related to the quality of the signal transmission.

Please refer to FIG. 1 and FIG. 2 showing a network cable plug which is used to be plugged into the network socket 10. The network cable plug includes a housing 11, an auxiliary piece 12, and a plurality of copper contacts 13. Each of the copper contacts 13 includes a contact part 131 and a connection part 132. The contact part 131 is used to contact with the pins embedded in the socket 10 and the connection part 132 is used to couple with a cable tightly. The auxiliary piece 12 is used for assisting the housing 11 to be plugged in and drawn out the network socket 10. The housing 11 is a transparent plastic. FIG. 2 is the amplified diagram of the copper contact 13.

Nevertheless, the conventional network cable plug has the following disadvantages:

1. The conventional network cable plug is not liable to be manufactured. When manufacturing, the copper contacts must be inserted into the slits one by one. If the copper contacts are inserted manually, it is transparently inefficient and time-consuming. However, if an automatic equipment is purchased for inserting the copper contacts automatically, the profit will be reduced thereby.

2. The conventional network cable plug can only match the TIA568A CAT-5 specification. It can not match the specification for high-speed signal transmission beyond the CAT5e specification.

3. The reason why the network cable plug can not match the specification for high-speed signal transmission beyond CAT5e is the restriction of its structure. Therefore, the so-called cross-talk interference will be generated during the signal transmission.

In order to reduce the crosstalk among transmissions, the shape, size, thickness and dimensions of the metal contact blades are manipulated to restore capacitance. Hence it is desired to develop an electrical connector for matching specifications beyond CAT5e and reducing the crosstalk interference among transmissions.

SUMMARY OF THE INVENTION

Therefore, an object of the present invention is to provide an electrical connector which is more practical and easier to be manufactured.

Another object of the present invention is to provide an electrical connector which can match the specification for the high-speed signal transmission beyond CAT5e specification.

Another further object is to provide a metal contact assembly used within an electrical connector.

Another yet object of the present invention is to provide an electrical connector which can reduce the crosstalk interference generated during the signal transmission.

According to the present invention, the electrical connector includes a plurality of metal contact assemblies, a slit base, and a housing. The slit base has a plurality of slits for inserting therein the plurality of metal contact assemblies, and the housing has a slot for slidably receiving the slit base and a plurality of openings for respectively exposing a portion of the metal contact assemblies.

Certainly, the slit base and the housing are made of plastic.

In accordance with the present invention, each of the metal contact assemblies includes a first metal contact and a corresponding second metal contact, wherein each of the metal contact assemblies are inserted into the slits in turn and in parallel so that the mutual arrangement of the first metal contacts and the second metal contacts is interlaced.

In accordance with the present invention, each of the first metal contacts further includes a first contact part extending through a corresponding opening of the housing for making an electrical contact external to the housing, and a second contact part for making a connection external to the housing.

In accordance with the present invention, each of the second metal contacts further includes a third contact part extending through a corresponding opening of the housing for making an electrical contact external to the housing, and a fourth contact part for making a connection external to the housing.

Furthermore, each of the first metal contacts further includes a plurality of teeth extending upwardly from the bottom edge of the first metal contact and each of the second metal contacts further includes a corresponding plurality of teeth extending downwardly from the top edge of the second metal contact so as to from a desired capacitance.

Alternatively, both of the second contact part and the fourth contact part are a pin for welding on a printed circuit board (PCB).

Alternatively, both of the second contact part and the fourth contact part are a two-prong pin for displacing the wire insulation in order to electrically connect with the cable.

Alternatively, both of the second contact part and the fourth contact part are a three-prong pin for piercing a cable and electrically connecting with the cable.

Alternatively, both of the second contact part and the fourth contact part are a semicircle for fixing a cord by means of squeezing to electrically connect with the cable.

Preferably, the metal contact assemblies are made of copper.

The present invention also provides a metal contact assembly used within the electrical connector, wherein the electrical connector includes a slit base having a plurality of slits and a housing having a slot for slidably receiving the slit base. The metal contact assembly includes: a first metal contact inserted in one of the slits of the slit base and has a first contact part extending through an opening of the housing for making an electrical contact external to the electrical connector, and a second contact part for making a connection external to the housing. The metal contact assembly further includes a second metal contact inserted in one of the slits adjacent to that of the first metal contact in parallel and has a third contact part extending through an opening of the housing for making an electrical contact external to the electrical connector, and a fourth contact part for making a connection external to the housing.

Both of the above metal contacts are characterized in that each of the first metal contacts include a plurality of teeth extending upwardly from the bottom edge of the first metal contacts and each of the second metal contacts includes a corresponding plurality of teeth extending downwardly from the top edge of the second metal contact so as to from a desire capacitance.

Now the foregoing and other features and advantages of the present invention will be more clearly understood through the following descriptions with reference to the accompanying drawings, in which:

DETAILED DESCRIPTION OF THE PREFERRED EMBODIMENTS

The present invention will now be described more minutely with reference to the following embodiment. It is to be noted that the following descriptions of preferred embodiment of this invention are presented herein for the purpose of illustration and description only. It is not intended to be exhaustive or not to be restricted to the precise form disclosed.

Figure 1:
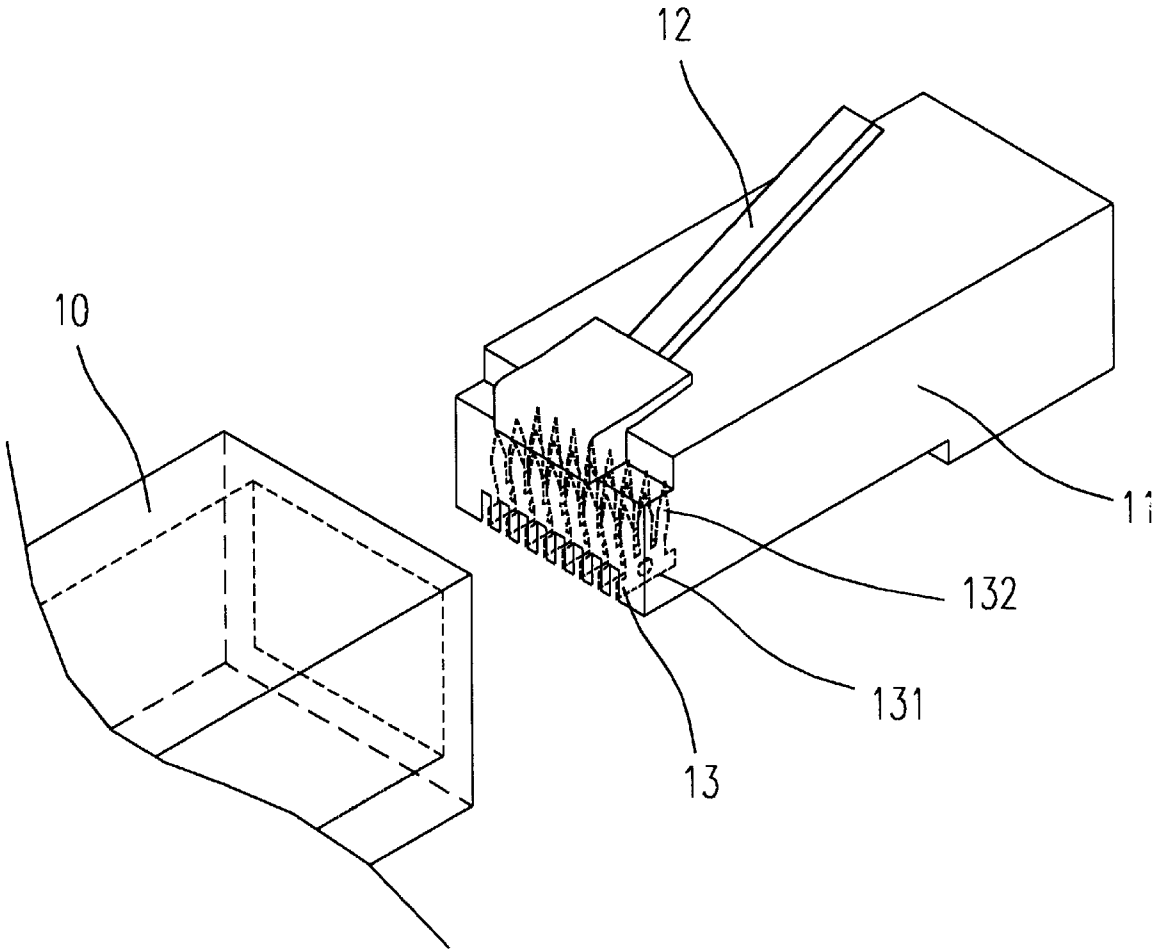
Fig. 1(PRIOR ART)
FIG. 1 is a schematic diagram showing the conventional electrical connector.
Figure 2:
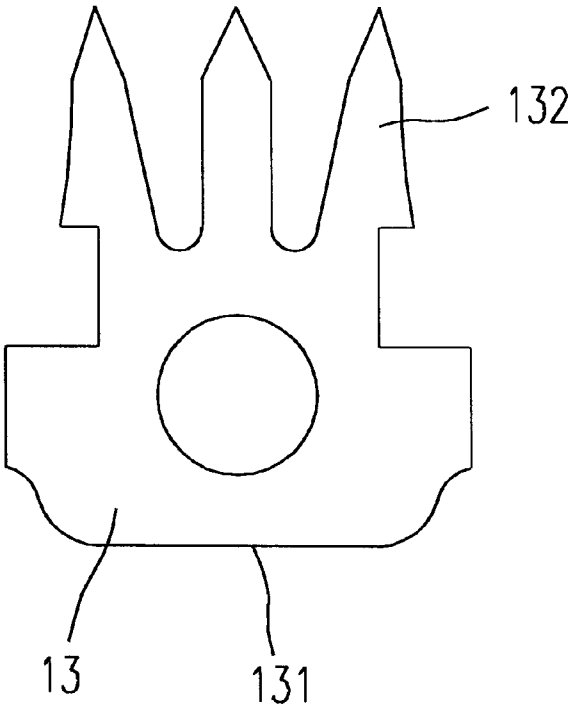
Fig. 2(PRIOR ART)
FIG. 2 is an amplified diagram showing the metal contact used within the conventional electrical connector.
Figure 3:
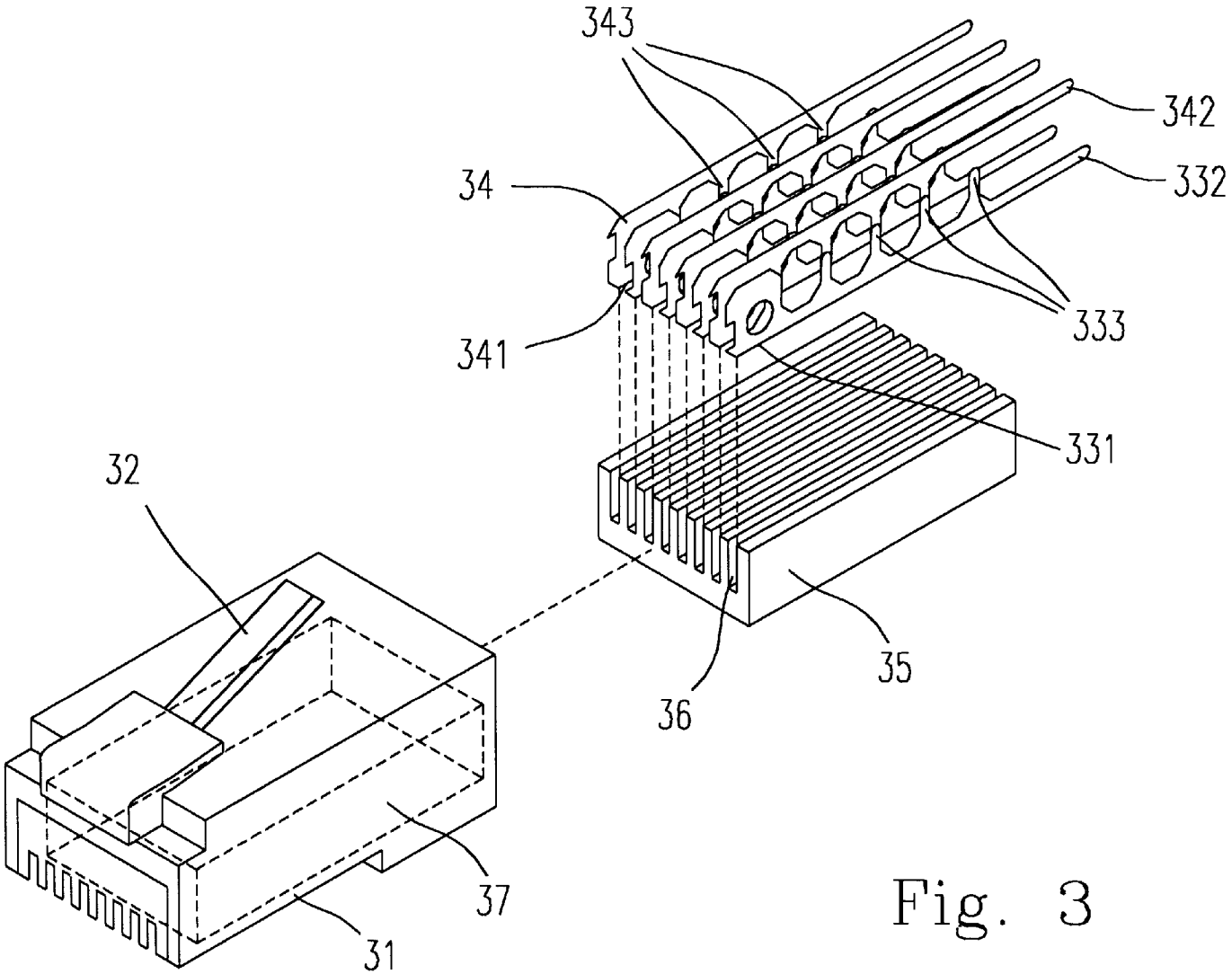
FIG. 3 is a schematic diagram showing the electrical connector structure according to the present invention.
Figure 4:
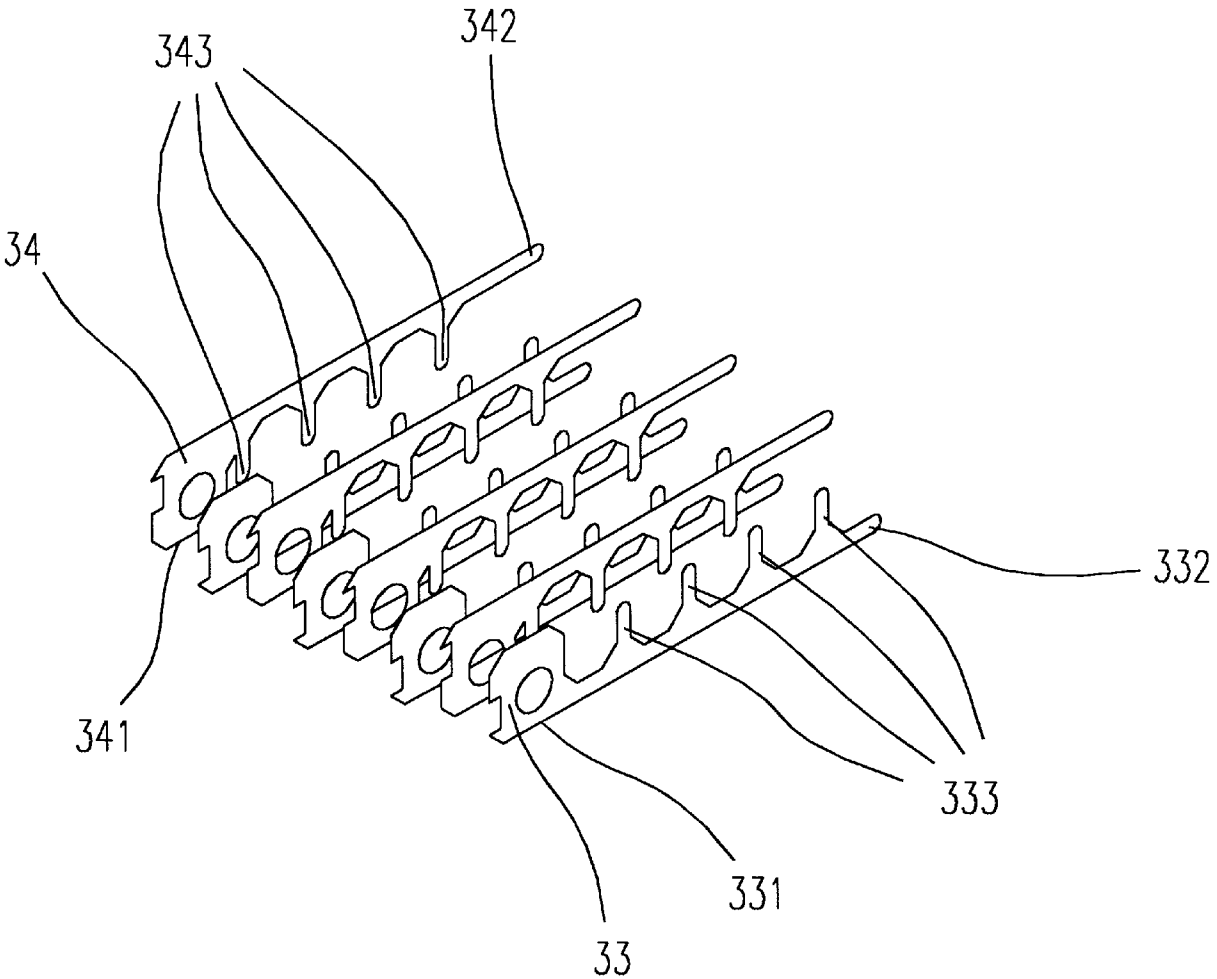
FIG. 4 is a schematic diagram showing the first perferred embodiment of the metal contact assembly used within an electrical connector according to the present invention.

Please refer to FIG. 3 and FIG. 4 showing the electrical connector and the metal contact assembly of the present invention. The electrical connector includes a housing 31 and a slit base 35. The housing 31 has a slot 37 for slidably receiving the slit base 35. The auxiliary piece 32 is used for assisting the housing 31 to be plugged into a socket. The housing 31 and the slit base 35 are both made of plastic.

There are eight slits 36 mounted on the slit base 35 for inserting therein a plurality of metal contact assemblies. Each of the metal contact assemblies includes a first metal contact 33 and a second metal contact 34. Both of the metal contacts are made of copper. The first metal contact 33 has a plurality of teeth 333 extending upwardly from the bottom edge of the first metal contact 33 and the second metal contact 34 also has a corresponding plurality of teeth 343 extending from the top edge of the second metal contact 34. Therefore, the shape of the first metal contact 33 and that of the second metal contacts 34 are complement so that the mutual arrangement of the metal contacts forms a desired capacitance. The first metal contacts 33 and the second metal contacts 34 are inserted into the slits 36 in turn and in parallel.

Certainly, the quantity and the size of the teeth are not confined to the above-described embodiment, and depends on the designed specification. Besides, their mutual arrangement is flexible, for instance, two first metal contacts 33 and two second metal contacts 34 can be spacedly interposed in parallel, or four first metal contacts 33 and four second metal contacts 34 can be spacedly interposed in parallel.

The first metal contact 33 further include a first contact part 331 and a second contact part 332, and the second metal contact 34 further include a third contact part 341 and a fourth contact part 342. The first contact part 331 and the third contact part 341 are exposed externally to the housing 31 and contacted with the pins embedded in a socket when the housing 31 is plugged into the socket. The second contact part 332 and the fourth contact part 342 can be welded into a printed circuit board (PCB) for transmitting the electric signal.

Figure 5:
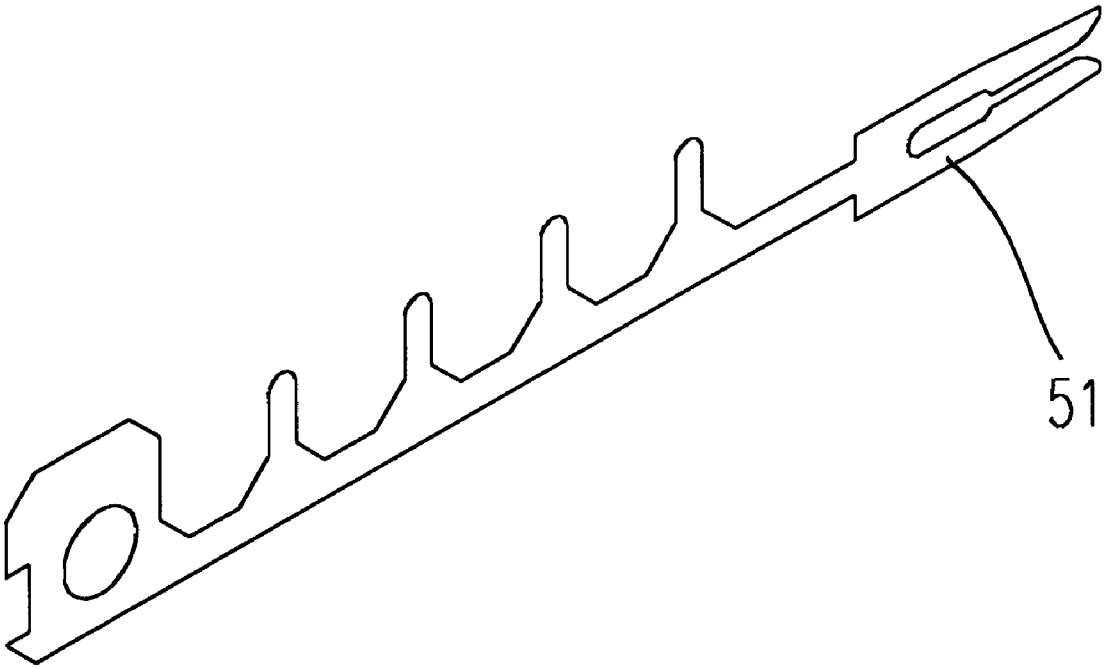
FIG. 5 is a schematic diagram showing the second preferred embodiment of the metal contact assembly used within an electrical connector according to the present invention.
Figure 6:
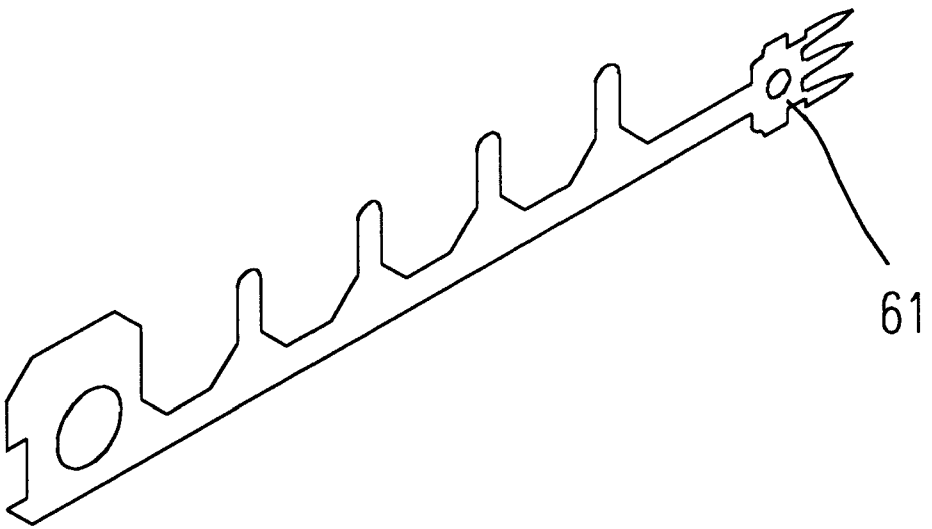
FIG. 6 is a schematic diagram showing the third preferred embodiment of the metal contact used within an electrical connector according to the present invention.
Figure 7:
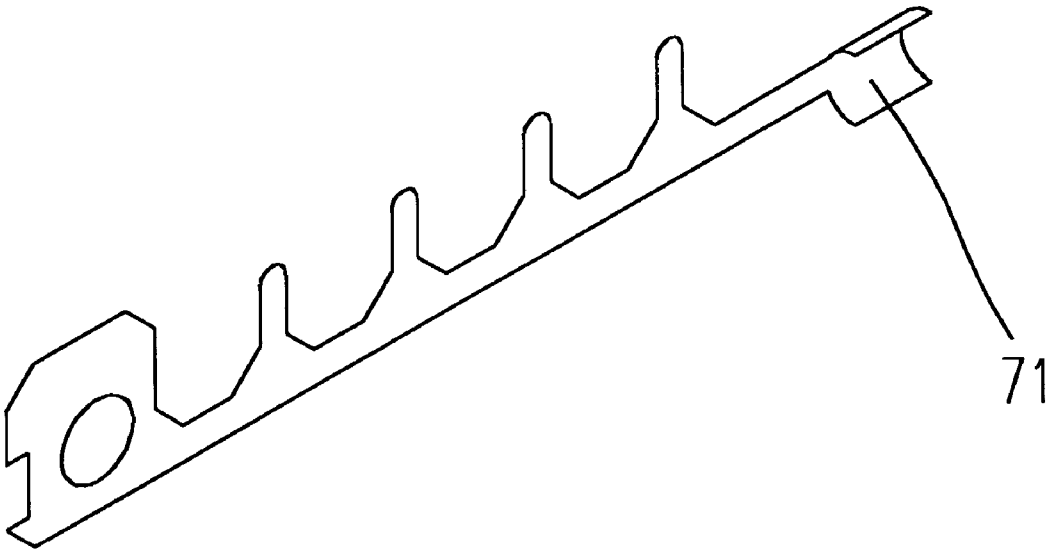
FIG. 7 is a schematic diagram showing the fourth preferred embodiment of the metal contact used within an electrical connector according to the present invention.

Please refer to FIG. 5, FIG. 6, and FIG. 7. The metal contact assembly can have many types. The contact part 51 of the metal contact assembly shown in FIG. 5 is a two-prong pin for displacing the wire insulation and electrically connect with the cable. The contact part 61 of the metal contact assembly shown in FIG. 6 is a three-prong pin for piercing a cable and electrically connect with the cable, and the contact part 71 of the metal contact assembly shown in FIG. 7 is a semicircle for fixing a cord by means of squeezing.

One characteristic of the electrical connector structure of the present invention is that the electrical connector is constituted by the housing and the slit base. Thus, the manufacturing process will be simplified. When manufacturing the electrical connector, the manufacturer only needs to insert the metal contacts into the slits of the slit base in advance and then slidably placing the slit base in the slot of the housing tightly.

Another characteristic of the electrical connector structure of the present invention is that the shape of first metal contact and that of the second metal contact are complement, and both of them are arranged to form the desired capacitance. Therefore, the crosstalk interference generated during the signal transmission will be reduced and the electrical connector formed thereby can match the specifications beyond CAT5e for high-speed signal transmission.

It is intended to emphasize that the shape used to form the desired capacitance is not limited to the form of teeth as shown in the diagrams. On the contrary, it can be any form that can form the desired capacitance for reducing the crosstalk interference.

Comparing the electrical connector structure of the present invention with that of the prior art, the former is more practical and easy to be fabricated, and can be employed in the application of high-speed signal transmission.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not taken as limiting the scope of the present invention which is defined by the appended claims.

What we claim is:

1. An electrical connector, comprising:

a plurality of metal contact assemblies for forming a desired capacitance;

a slit base having a plurality of slits for inserting therein said plurality of metal contact assemblies; and, a housing having a slot for slidably receiving said slit base and having a plurality of openings for respectively exposing a portion of each of said metal contact assemblies;

wherein each of said metal contact assemblies includes a first metal contact and a corresponding second metal contact, wherein each of said first metal contacts further includes a plurality of teeth extending upwardly from the bottom edge of said first metal contact and each of said second metal contacts includes a corresponding plurality of teeth extending downwardly from the top edge of said second metal contact so as to form said desired capacitance.

2. An electrical connector according to claim 1, wherein said slit base and said housing are made of insulating material.

3. An electrical connector according to claim 2, wherein said insulating material is a plastic.

4. An electrical connector according to claim 1, wherein each of said first metal contacts and each of said second metal contacts are inserted in said slits in turn and in parallel so that the mutual arrangement of said first metal contacts and said second metal contacts is interlaced.

5. An electrical connector according to claim 4, wherein each of said first metal contacts includes:

a first contact part extending through said opening of said housing for making an electrical contact external to said housing; and a second contact part for welding on a printed circuit board (PCB).

6. An electrical connector according to claim 5, wherein each of said second metal contacts includes:

a third contact part extending through said opening of said housing for making an electrical contact external to said housing; and a fourth contact part for welding on a printed circuit board (PCB).

7. An electrical connector according to claim 6, wherein both of said second contact part and said fourth contact part are a pin.

8. An electrical connector according to claim 4, wherein each of said first metal contacts includes:

a first contact part extending through said opening of said housing for making an electrical contact external to said housing; and a second contact part for displacing the wire insulation to electrically connect with a cable.

9. An electrical connector according to claim 8, wherein each of said second metal contacts includes:

a third contact part extending through said opening of said housing for making an electrical contact external to said housing; and a fourth contact part for displacing the wire insulation to electrically connect with a cable.

10. An electrical connector according to claim 9, wherein both of said second contact part and said fourth contact part are a two-prong pin.

11. An electrical connector according to claim 4, wherein each of said first metal contacts includes:

a first contact part extending through said opening of said housing for making an electrical contact external to said housing; and a second contact part for piercing a cable and electrically connected with said cable.

12. An electrical connector according to claim 11, wherein each of said second metal contacts includes:

a third contact part extending through said opening of said housing for making an electrical contact external to said housing; and a fourth contact part for piercing a cable and electrically connected with said cable.

13. An electrical connector according to claim 12, wherein both of said second contact part and said fourth contact part are a three-prong pin.

14. An electrical connector according to claim 4, wherein each of said first metal contacts includes:

a first contact part extending through said opening of said housing for making an electrical contact external to said housing; and a second contact part for fixing a cord by means of squeezing.

15. An electrical connector according to claim 14, wherein each of said second metal contacts includes:

a third contact part extending through said opening of said housing for making an electrical contact external to said housing; and a fourth contact part for fixing a cord by means of squeezing.

16. An electrical connector according to claim 15, wherein both of said second contact part and said fourth contact part are a semicircle.

17. An electrical connector according to claim 1, wherein said metal contact assemblies are made of copper.

18. An electrical conductor, comprising:

a slit base having a plurality of slits for inserting therein a plurality of metal contact assemblies, wherein each of said metal contact assemblies includes a first metal contact and a second metal contacts contact; and a housing having a slot for slidably receiving therein said slit base and having a plurality of openings for respectively exposing a portion of each said metal contact assembly, wherein each of said first metal contacts and said second metal contacts are inserted in said slits in turn and in parallel so that the mutual arrangement of said first metal contacts and said second metal contacts is interlaced, each of said first metal contacts including a plurality of teeth extending upwardly from the bottom edge of said first metal contacts and each of said second metal contacts including a corresponding plurality of teeth extending downwardly from the top edge of said second metal contacts so as to form a desired capacitance.

19. A metal contact assembly adapted to be used within an electrical connector for reducing the crosstalk interference, wherein said electrical connector includes a slit base having a plurality of slits and a housing having a slot for slidably receiving said slit base, comprising:

a first metal contact inserted in one of said slits of said slit base and having a first contact part extending through an opening of said housing for making electrical contact external to said housing, and a second contact part for making electrical connection external to said housing; and a second metal contact inserted in one of said slits adjacent to that of said first metal contact in parallel and having a third contact part extending through an opening of said housing for making electrical contact external to said housing, and a fourth contact part for making electrical connection external to said housing;

and characterized in that each of said first metal contacts include a plurality of teeth extending upwardly from the bottom edge of said first metal contacts and each of said second metal contacts includes a corresponding plurality of teeth extending downwardly from the top edge of said second metal contacts so as to form a desired capacitance for reducing said crosstalk interference.

20. A metal contact assembly according to claim 19, wherein both of said second contact part and said fourth contact part are a pin for welding on a printed circuit board (PCB).

21. A metal contact assembly according to claim 19, wherein both of said second contact part and said fourth contact part are a two-prong pin for displacing the wire insulation to electrically connect with the cable.

22. A metal contact assembly according to claim 19, wherein both of said second contact part and said fourth contact part are a three-prong pin for piercing a cable and electrically connected with said cable.

23. A metal contact assembly according to claim 19, wherein both of said second contact part and said fourth contact part are a semicircle for fixing a cord by means of squeezing.

* * * * *